United States Patent [19]

Cruz

[11] Patent Number: 4,708,319

[45] Date of Patent: Nov. 24, 1987

[54] SYSTEM FOR RAISING AND LOWERING PORTABLE CARGO CONTAINERS

[76] Inventor: Graham J. Cruz, P.O. Box 8102, San Diego, Calif. 92102

[21] Appl. No.: 874,493

[22] Filed: Jun. 16, 1986

[51] Int. Cl.[4] ..... B66F 7/26

[52] U.S. Cl. ..... 254/45

[58] Field of Search ..... 254/45, 98, 100, 89 R, 254/92; 52/702; 248/300; 269/904; 410/82, 77, 81

[56] References Cited

U.S. PATENT DOCUMENTS

| | | | |
|---|---|---|---|
| 753,053 | 2/1904 | Eberhardt | 52/702 |
| 3,317,236 | 5/1967 | Connerat et al. | 410/82 |
| 3,749,363 | 7/1973 | Hauser | 254/45 |
| 3,881,689 | 5/1975 | Bury et al. | 254/45 |
| 4,045,000 | 8/1977 | Mai | 254/45 |
| 4,082,250 | 4/1978 | Allmon et al. | 254/45 |
| 4,594,017 | 6/1986 | Hills | 52/702 |

*Primary Examiner*—Robert C. Watson

*Attorney, Agent, or Firm*—Charles C. Logan, II

[57] ABSTRACT

A system for raising and lowering portable cargo containers that utilizes at least four jack attachment brackets, four screw jacks each having a support nut on their screw member, and means to raise and lower the screw jacks simultaneously. Each of the jack attachment brackets has a major vertical plate member and a minor vertical plate member that are connected together to form a right angular structure. There are elongated apertures adjacent to both of their bottom ends. Locking pins are inserted through the apertures into aligned holes that are located in fittings at the bottom corners of the portable cargo containers. A horizontal support plate extends outwardly from the top edge of the major vertical plate member at a ninety degree angle. A slot is formed in its outer most edge to allow passage therethrough of the screw of a screw jack. A nut on the screw would be captured by the horizontal support plate thereby lifting and lowering the jack attachment bracket as the screw jack is operated. A pair of stabilizing guide bars have apertures adjacent their opposite ends that receive the top ends of the screws of the screw jacks. Guide rollers are mounted along the interior wall surface of the stabilizing guide bars and they maintain contact with the walls of a cargo container as it is raised and lowered.

7 Claims, 6 Drawing Figures

SYSTEM FOR RAISING AND LOWERING PORTABLE CARGO CONTAINERS

BACKGROUND OF THE INVENTION

The present invention relates to a lifting system for raising and lowering interchangable freight containers adapted to be hauled by automotive trucks. These containers are in daily use throughout the world and are commonly seen transported by common carriers via ships, trains and trucks, withh diverse lines of commodities, limited only in that size of cargo not exceed dimensional physical confines of container. Containers are normally of standard height and width, varying only in length. Standard available lengths are 20, 40, and 45 feet.

In the past various types of structures and systems have been used for raising and lowering the portable cargo containers from a truck. Most of these systems require hydraulic jacks that are structurally mounted on the corners of the cargo containers. This type of structure is illustrated in U.S. Pat. No. 3,476,275 of Cowlishaw et al., in U.S. Pat. No. 3,749,363 to Houser, and in U.S. Pat. No. 4,053,073 to Franchin.

Another approach has been to have support legs pivotally attached to the bottom of the cargo containers so that they may be unloaded and stand on their own. This type of structure is illustrated in U.S. Pat. No. 3,632,072 to Blackburn and in U.S. Pat. No. 3,773,199 to Arvidsson.

Another approach has been to have the hydraulic jacks mounted on the frame of the truck and utilize these for lifting the cargo container off the frame. This structure is illustrated in U.S. Pat. No. 3,817,413 to Ham.

Of the different systems and structures already devised, each have their own individual drawbacks. The structures having the jacks mounted on the cargo containers would require brand new cargo containers to be manufactured and could not be used with existing cargo containers. Likewise the system that has the hydraulic jacks mounted on the frame of the truck would require modification of the existing truck frames and also require new cargo containers to be used therewith.

Applicant's novel system would allow existing cargo containers to be used without the necessity of modifying their structure. Also it would not be necessary to modify the truck or its frame to utilize applicant's system. Furthermore, a set of the four jack attachment brackets and four screw jacks are basically all that would be necessary in order to utilize the system.

It is an object of the invention to provide a novel system for raising and lowering portable cargo containers that could be used with existing cargo containers without the need to modify them.

It is also an object of the invention to provide a novel system for raising and lowering portable cargo containers that does not require the truck or its frame to be modified in order to use the system.

It is another object of the invention to provide a novel system for raising and lowering portable cargo containers having unique jack attachment brackets. It is an additional object of the invention to provide a novel system for raising and lowering portable cargo containers that can be installed and removed by the truck driver.

It is a further object of the invention to provide a novel system for raising and lowering portable cargo containers that is economical to manufacture and market. This invention is totally portable and can therefore be used on any length of container, but not necessarily restricted to aforementioned containers, as its concept in utility and convenience are only limited in scope by the needs, ingenuity, and prudent means by which its wide range of applications may be safely attained. Any location accessible by a single heavy-duty truck or railroad is all that is needed to use the system. The invention also opens the potential of decreasing costs of operation in reducing the conventional trailer population, thereby saving fleets license fees, insurance fees, maintenance fees, warehouse fees, etc., and other costs and charges inherent to the industry as it is now known to incurr, due to the nature and present day limitations of the business. Benefits of the invention are just too numerous and broad to cover at this time; but the possibilities of application will have been opened to a wide spectrum of uses due to its simplicity, portability, practicality, and feasibility.

SUMMARY OF THE INVENTION

Applicant's novel system for raising and lowering portable cargo containers has been designed to function with existing portable cargo containers without the need to modify their structure. The system also utilizes equipment that does not need to be permanently attached to either the portable cargo containers or the truck that transports the cargo containers. The basic structure for utilizing this system is made up of at least four jack attachment brackets, at least four screw jacks, and control mechanism for raising and lowering the screw jacks simultaneously.

The jack attachment brackets are designed for portable cargo containers of the type having fittings at its bottom corners containing a pair of vertical surfaces formed at right angles to each other which each of these having holes adapted to serve as anchoring means. The jack attachment brackets themselves are formed from a major vertical plate and a minor vertical plate that are rigidly connected together adjacent their bottom edges at a ninety degree angle. These plates have an elongated aperture in them adjacent their bottom end that mates with the holes in the fittings at the bottom corners of the portable containers. The major vertical plate member has a predetermined height H and extending laterally from its top edge is a horizontal support plate of a predetermined length L that is rigidly connected thereto to form a right angular structure. The front end of the horizontal support plate has a slot formed in it for receiving the screw of the jack screw and allowing it to pass vertically therethrough. A support nut on the screw of the screw jack would have a width wider than that of the slot thus preventing it from passing therethrough. The horizontal support plate would thus be supported on the screw nut and its travel up and down the jack screw would cause the portable cargo container to be raised and lowered.

The height H of the major vertical plate member is preferably between 6 inches to 24 inches. This is required in order to have sufficient clearance for the gear housing of the jack screws so that they may be positioned beneath the horizontal support plate. The length L of the horizontal support plate is preferably between 6 to 24 inches long. The reason for this dimension is to allow adequate spacing between the respective pairs of jack screws which support the portable cargo container. This spacing of the two jack screws allows the trailer portion of the truck to be backed underneath the raised portable cargo container with adequate clearance on either side of the truck bed frame so that it does not crash into either of the separated jack screws.

A stabilizing guide bar having a length at least as great as the spacing of the pairs of jack screws, has an aperture formed adjacent each of its opposite ends that telescopically fits over the top tip portion of the respective screws of the jack screws. The stabilizing guide bar provides rigidity to the pairs of jack screws as the portable cargo container is raised and lowered. The stabilizing guide bar has two right angular portions intermediate its ends and guide rollers or guide pads are mounted on the inside surfaces thereof and these maintain contact with the walls of the portable cargo container as it is raised and lowered.

The jack screws may be of the type that are powered by pneumatic fluid, hydraulic fluid, or electricity. Although these jack screws may be driven individually, it is preferable they be controlled so that they raise and lower all of the jack attachment brackets simutaneously to maintain the portable cargo containers in a level orientation. This is accomplished by having the individual jack screws connected to a distribution control unit of a type which is state of the art. The source of the power for operating the distribution control unit or the incividual jack screws themselves can either be an auxillary power unit or it may use the pneumatic air, hydraulic, or electrical system of the truck itself.

DESCRIPTION OF THE PREFERRED EMBODIMENT

Applicant's novel system for raising and lowering portable cargo containers will now be described by referring to FIGS. 1–6 on the drawings. The system is generally designated numeral 10. It has a plurality of jack screws 12 that are all connected to a central distribution control unit 14. A source of power 16 is connected to the distribution control unit. The source of power may be an auxillary unit or it may be the resources of the truck itself for driving either a pneumatic, hydraulic, or electrically powered jack screws.

Figure 1:
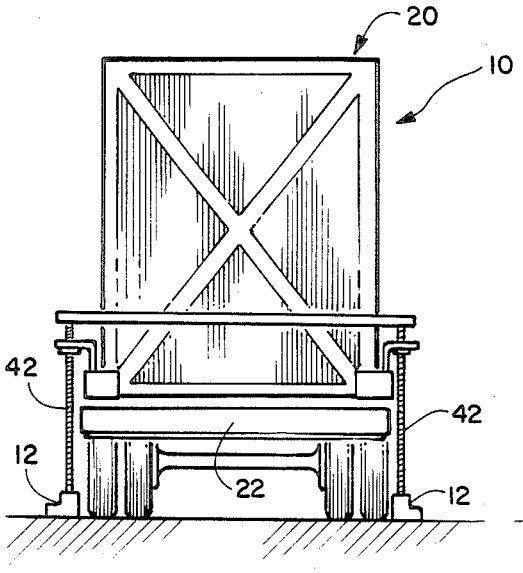
FIG. 1 is a rear elevation view illustrating the novel system for raising and lowering portable cargo containers as it is being used to lift the cargo container from the bed of a truck.
Figure 2:
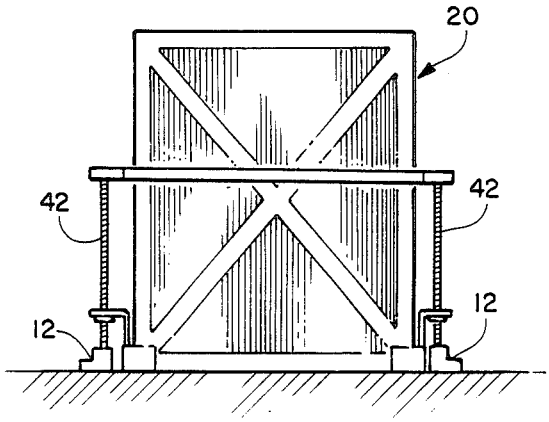
FIG. 2 is a rear elevation view illustrating the portable cargo container after it has been lowered to the ground.

In FIG. 1 a pair of jack screws 12 are shown adjacent the rear corners of a portable cargo container 20. A similar pair of jack screws 12 would be positioned adjacent the front corners of the portable cargo container. In FIG. 2 the truck bed 22 has been pulled out from under the portable cargo container 20 and it has been lowered to the ground by its respective jack screws 12.

Figure 3:
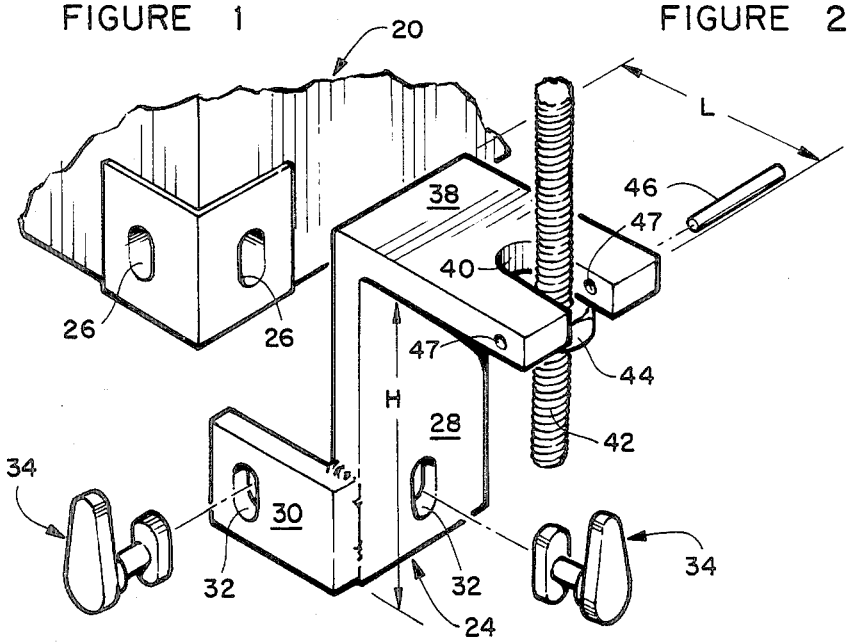
FIG. 3 is an exploded partial perspective view illustrating one of the jack attachment brackets and the manner in which it is connected to the bottom corners of the portable cargo containers.
Figure 4:
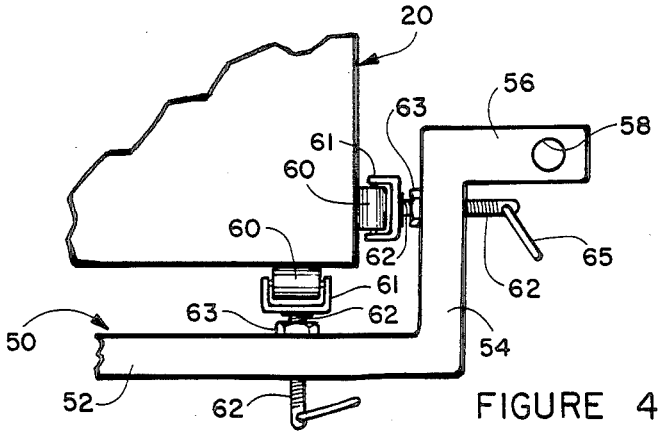
FIG. 4 is a partial top elevation view illustrating how the stabilizing guide bar contacts the side walls of the portable cargo container.
Figure 5:
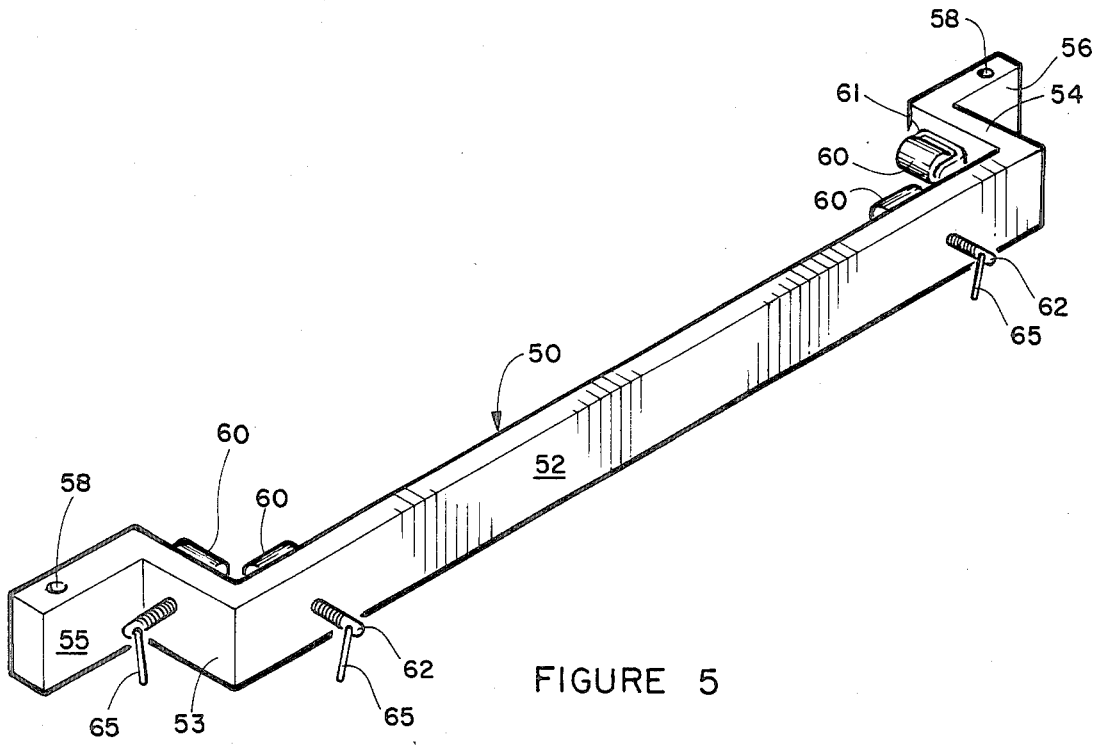
FIG. 5 is a front perspective view of the stabilizing guide bar.
Figure 6:
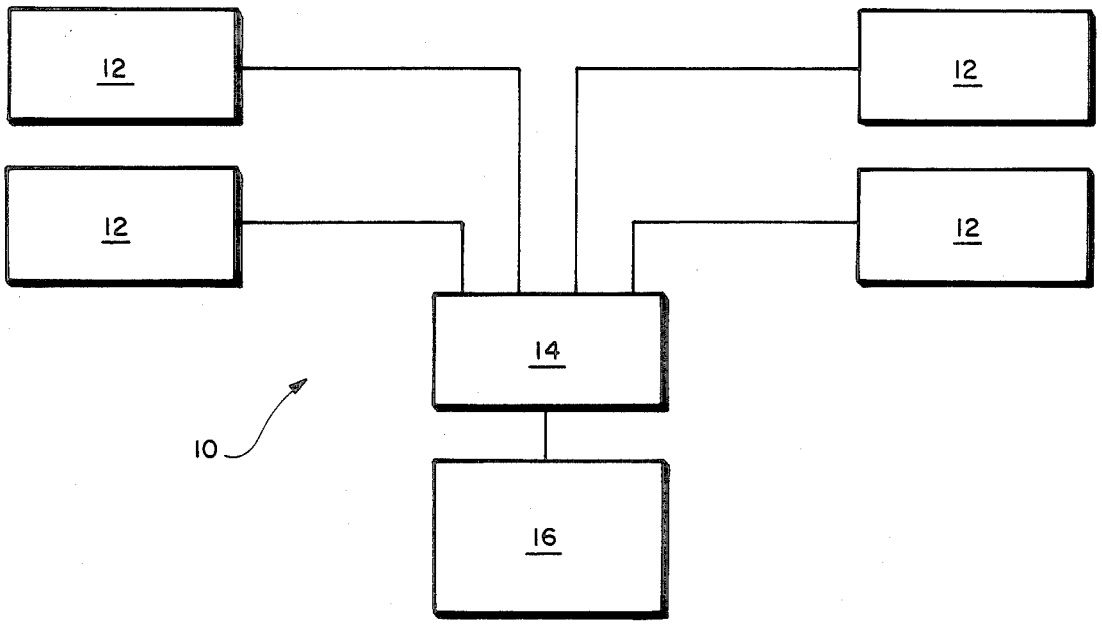
FIG. 6 is a schematic illustration of the system for raising and lowering portable cargo containers.

The specific structure of the jack attachment brackets 24 is best understood by referring to FIG. 3. The bottom corners of the portable cargo container 20 has existing fixture structure having elongated apertures 26. The jack attachment bracket 24 has a major vertical plate member 28 and an minor vertical plate member 30 that are formed at right angles to each other. Each of them have an elongated aperture 32 adjacent their bottom ends that align with elongated apertures 26 on the portable cargo containers. Locking pins 34 are inserted through the respective elongated apertures and turned a quarter turn to lock them in position and secure the jack attachment bracket to the corners of the portable containers. A horizontal support plate 38 extends inwardly at a right angle to the top edge of vertical plate member 28. Horizontal support plate 38 has a length L and major vertical plate member 28 has a height H. The front end of horizontal support plate 38 has a slot 40 formed therein through which passes the screw 42 of the respective jack screws 12. A support nut 44 is wider than slot 40 and is captured beneath the horizontal support plate and it causes the horizontal support plates to be raised and lowered according to the direction in which the screw 42 is rotated.

A stabilizing guide bar 50 is used to provide rigidity to the system and maintain the spacing between the top ends of the screws 42 of the respective pairs of jack screws 12. Stabilizing guide bar 50 is formed from a cross member plate 52 having right angular corner plates 53 and 54 formed at its opposite ends. Leg members 55 and 56 extend outwardly at right angles to the respective corner plate members 53 and 54. Vertically oriented apertures 58 are formed in the leg members 55 and 56 and they telescope over the top tip end of the screws 42. Guide rollers 60 or rubber snubbers are supported adjacent the inner surface of the stabilizing guide bar to maintain guide control contact with the side walls of the portable cargo containers as they are raised and lowered. The rollers are supported in yokes 61 having a threaded shank 62 extending from their rear end. Shank 62 is received in threaded nut 63. A handle 65 is attached the end of shank 62.

What is claimed is:

1. A system for raising and lowering portable cargo containers of the type having fittings at their bottom corners containing a pair of vertical surfaces formed at right angles to each other with each having holes adapted to serve as anchoring means comprising:

at least four screw jacks each having a support nut on their screw member;

means to raise and lower said screw jacks simultaneously;

at least four jack attachment brackets each of which comprises a major vertical plate member having a predetermined height II and having an elongated aperture in it adjacent its bottom end, a minor vertical plate member is rigidly connected to one edge of said major vertical plate member adjacent its bottom end to form a right angular structure, said minor vertical plate member having an elongated aperture in it adjacent its bottom end, and a horizontal support plate of a predetermined length L rigidly connected to the top edge of said major vertical plate member to form a right angular structure, said support plate having means for allowing a jack screw to pass vertically therethrough; and a pair of stabilizing guide bars each having an aperture adjacent their opposite ends for receiving the top end of the screw jacks.

2. A jack attachment bracket as recited in claim 1 wherein said height H is within the range of 6 inches to 24 inches.

3. A jack attachment bracket as recited in claim 1 wherein said length L is within the range of 6 inches to 24 inches.

4. A jack attachment bracket as recited in claim 1 wherein said means for allowing a jack screw to pass therethrough comprises a slot formed in the outer edge of said horizontal support plate.

5. A jack attachment bracket as recited in claim 1 further comprising a locking pin for said apertures in said major vertical plate member and said minor vertical plate member.

6. A system for raising and lowering portable cargo containers as recited in claim 1 wherein each of said stabilizing guide bars comprises:

an elongated cross member plate of a predetermined length;

a corner plate formed at each of the ends of said cross member plates; and a leg member extending from the free end of said corner plates.

7. A system for raising and lowering portable cargo containers as recited in claim 6 further comprising guide roller means mounted on said stabilizing guide bar that maintains contact with the walls of a cargo container as it is raised and lowered.

* * * * *